US005713293A

United States Patent [19]

Shiffler et al.

[11] Patent Number: 5,713,293

[45] Date of Patent: Feb. 3, 1998

[54] UNMANNED SEA SURFACE VEHICLE HAVING A PERSONAL WATERCRAFT HULL FORM

[75] Inventors: Mark E. Shiffler, Annapolis, Md.; Luke W. Loy, Washington, D.C.

[73] Assignee: The United States of America as represented by the Secretary of the Navy, Washington, D.C.

[21] Appl. No.: 532,196

[22] Filed: Sep. 22, 1995

[51] Int. Cl.[6] ..... B63B 1/00

[52] U.S. Cl. ..... 114/56; 440/38; 114/1

[58] Field of Search ..... 440/38, 77, 88; 114/270, 144 A, 240 R, 440, 1, 349, 56, 68; D12/300; 89/1.11

[56] References Cited

U.S. PATENT DOCUMENTS

| | | | |
|---|---|---|---|
| 2,397,107 | 3/1946 | Hammond, Jr. | 89/1.11 |
| 4,509,926 | 4/1985 | Jacobson | 114/270 |
| 4,622,557 | 11/1986 | Westerfield | 342/357 |
| 4,628,855 | 12/1986 | Nishida | 114/270 |
| 4,990,920 | 2/1991 | Sanders, Jr. | 342/14 |
| 5,036,789 | 8/1991 | Kelly et al. | 114/270 |
| 5,111,401 | 5/1992 | Everett, Jr. et al. | 364/424.02 |
| 5,117,731 | 6/1992 | Mendenhall | 89/1.816 |
| 5,167,550 | 12/1992 | Nielsen | 114/270 |
| 5,170,352 | 12/1992 | McTamaney et al. | 364/424.02 |
| 5,170,735 | 12/1992 | Kobayashi | 114/270 |
| 5,189,612 | 2/1993 | Lemercier et al. | 364/424.02 |
| 5,202,829 | 4/1993 | Geier | 364/449 |
| 5,229,941 | 7/1993 | Hattori | 364/424.02 |
| 5,319,376 | 6/1994 | Eninger | 342/357 |
| 5,321,614 | 6/1994 | Ashworth | 364/424.02 |
| 5,344,105 | 9/1994 | Youhannaie | 244/3.14 |
| 5,367,456 | 11/1994 | Summerville et al. | 364/424.02 |

OTHER PUBLICATIONS

Kiely, Dr. D. G., Naval Electronic Warfare, Brassey's Defence Publishers, Vo. 5 of Brassey's Sea Power: Naval Vessels, Weapons Systems and Technology Series, McLean, Virginia, 1988.

"Canopy for Small Watercraft Invented," Navy Domestic Technology Transfer Fact Sheet, Nov. 93, vol. 18, No. 11, p. 1.

Walker, Robert (Palmer, Robert), "Barracuda: Unmanned Sea Surface Vehicle for Multi-Application Roles," Unmanned Systems, Winter 95, vol. 13, No. 1, pp. 17–22, plus Cover & pp. 3 & 5.

"Unmanned Undersea Vehicles: New Missions—New Capabilities," Unmanned Systems, Winter 93, vol. 11, No. 1, pp. 29–31 plus Cover & pp. 1–2.

*Primary Examiner*—Ed L. Swinehart
*Attorney, Agent, or Firm*—Howard Kaiser

[57] ABSTRACT

An unmanned marine surface vehicle (UMSV) featuring structural incorporation of the hull of a typical commercially distributed, recreationally enjoyed personal watercraft (PWC). The intrinsic qualities of the PWC hull, especially as pertains to superior seaworthiness and smaller size, avail the UMSV and UMSV system according to this invention. A contoured upper casing which is coupled with the PWC hull serves not only to further the fluid-dynamic integrity of this invention's UMSV but also to house electrical or mechanical components which are designed for effectuating specific military or civilian missions. This invention's UMSV is small, compact, lightweight, durable, rugged, uncomplicatedly direct-driven and quite seaworthy, and hence offers possible advantages over vessels conventionally considered for autonomous or semi-autonomous operations, particularly in terms of cost-effectiveness, expendability, deployability, recoverability, maneuverability and versatility.

10 Claims, 7 Drawing Sheets

UNMANNED SEA SURFACE VEHICLE HAVING A PERSONAL WATERCRAFT HULL FORM

The invention described herein may be manufactured and used by or for the Government of the United States of America for governmental purposes without the payment of any royalties thereon or therefor.

BACKGROUND OF THE INVENTION

The present invention relates to unmanned vehicles and unmanned vehicle systems, more particularly to unmanned marine surface vehicles and unmanned marine surface vehicle systems.

An unmanned vehicle is an autonomous or semi-autonomous craft which performs one or more functions as if one or more persons were aboard. In recent years developmental interest in unmanned land, sea, air and space vehicles and vehicle systems has increased for a variety of military and civilian applications. Basic to the attractiveness of unmanned vehicle utilization is the ability to perform dangerous or hazardous tasks without risk to humans. The potential economic benefits of using unmanned vehicles are also gaining appreciation.

In the sea realm of unmanned vehicles and unmanned vehicle systems, both undersea vehicles/systems and sea surface vehicles/systems have been considered for naval and/or commercial use. See, e.g., "Unmanned Undersea Vehicles: New Missions—New Capabilities," *Unmanned Systems* (official publication of the Association for Unmanned Vehicle Systems), Winter 1993, Volume 11, Number 1, pages 29–31, incorporated herein by reference; Robert Palmer, "BARRACUDA: Unmanned Sea Surface Vehicle for Multi-Application Roles," *Unmanned Systems* (official publication of the Association for Unmanned Vehicle Systems), Winter 1995, Volume 13, Number 1, pages 17–22, incorporated herein by reference.

The BARRACUDA unmanned sea surface vehicle/system disclosed in *Unmanned Systems* Winter 1995 implements the Rigid Inflatable Boat Platform ("RIB-P") high-speed work-boat which is in conventional use by the U.S. Navy and the Canadian Navy. The RIB-P boat is a 23'9" fiberglass hulled boat which has a rubber inflatable collar installed around the gunwales and which exhibits strength and stability at high speeds. The BARRACUDA vehicle/system also includes a specially designed mast which accomodates payloads, a drone kit mounted in various sections of the vehicle, and a remote control system which involves digital signaling from a command receiver.

Among the onboard remote control elements of the BARRACUDA vehicle are an autopilot, a throttle/transmission controller, a processor, a command antenna, a command receiver, a GPS (Global Positioning System) receiver, a telemetry transmitter, a video transmitter, and a video camera. The directional autopilot and the throttle/transmission controller are both remotely controlled from a control station which is either shipboard or land-based. A telemetry signal which contains digital information regarding control parameters is transmitted by the control station. The command antenna receives the telemetry signal and feeds it to the command receiver. The processor (Onboard Telemetry Interface System, or "OTIS B") decodes this information and either implements commands or sends appropriate control signals. The processor also encodes various parameters (such as the vehicle's position) and passes them to the telemetry transmitter. The video camera mounted on the mast provides visual information. Through separate E-band telemetry systems, the telemetry signals and the video signals are transmitted back to the control station by the telemetry transmitter and the video transmitter, respectively.

Recent United States patents which dislose method or apparatus pertaining to control of autonomous or semi-autonomous vehicles include Summerville et al. U.S. Pat. No. 5,367,456; Ashworth U.S. Pat. No. 5,321,614; Hattori U.S. Pat. No. 5,229,941; Lemercier et al. U.S. Pat. No. 5,189,612; McTamaney et al. U.S. Pat. No. 5,170,352; Everett, Jr. et al. U.S. Pat. No. 5,111,401.

Possible operations for the BARRACUDA disclosed in *Unmanned Systems* Winter 1995 include military exercises (as a target or for video scoring), electronic countermeasures ("ECM") and electronic warfare ("EW"), and remote mine detecting. A BARRACUDA target can be appropriately augmented for meeting the requirements of a variety of naval combat systems. Video recording can replace the conventional triangulation approach to scoring for gunnery exercises. A number of BARRACUDA decoy vehicles having deception/jammer equipment installed can be deployed in a hostile environment. Forward minesweeping operations by BARRACUDA vehicles can search and sweep well ahead of a ship in the ship's future path. Other disclosed possible operational scenarios for BARRACUDA-like systems include surveillance, obstacles/booby traps, toxic waste disposal, and environmental monitoring/remediation.

BARRACUDA is not purported by the article in *Unmanned Systems* Winter 1995 to "have all the answers." Although the BARRACUDA concept has much to offer, its implementation of the RIB-P boat is inherently restrictive in the context of the diversity of possible unmanned sea surface vehicular applications.

In its construction, the BARRACUDA RIB-P boat has a deep vee planing hull composed of a fiberglass/foam core sandwich. The compartmentalized inflatable collar is added to the planing hull to improve buoyancy. When one collar chamber is damaged, the remaining chambers continue to function. Nevertheless, the inflatable collar is susceptible to damage, and the composite planing hull does not have great intrinsic buoyancy. Although the BARRACUDA RIB-P boat exhibits strength and stability at high speeds, it may not have a sufficient sea state capability for some unmanned sea surface vehicular applications.

Moreover, the approximately twenty-three foot RIB-P hull may be unsuitably or excessively large for some applications. A smaller craft not only would be more easily deployed and recovered but would also better lend itself to certain operations in shallow waters or confined spaces. The fifty-six foot unmanned target drone boat disclosed in *Unmanned Systems* Winter 1993 would appear to have even greater limitations due to size than would the smaller BARRACUDA RIB-P vessel.

Furthermore, the BARRACUDA system is disclosed as cost-effective because it implements the RIB-P vehicle which is presently in use by the Navy. However, it is conceivable that another system can even more cost-effectively utilize available hardware and perhaps even economically permit expendibility of its vessels.

SUMMARY OF THE INVENTION

In view of the foregoing, it is an object of the present invention to provide an unmanned sea surface vehicle which admits of efficient and versatile implementation in a remote control/telemetry system.

Another object of the present invention is to provide such a vehicle which is suitable for close or shallow operations.

Another object of this invention is to provide such a vehicle which is rugged and durable.

A further object of this invention is to provide such a vehicle which has high sea state capability.

Another object is to provide such a vehicle which has high speed capability.

A further object is to provide such a vehicle which may be easily deployed.

Another object is to provide such a vehicle which may be easily recovered.

A further object of the present invention is to provide such a vehicle which may be cost-effectively implemented in such a system.

A further object of this invention is to provide such a vehicle which may be expendibly implemented in such a system.

For several years commercially produced personal watercraft have been enjoyed by many as leisure and sport recreation vehicles. Earlier versions of personal watercraft had a high center of gravity and required significant operator skill; the rider would stand during normal modes of operation. Hence, the term "jet ski" to refer to these personal watercraft came into the lexicon.

Recent years have seen the development of more user-friendly personal watercraft having a lower center of gravity to accomodate seated positioning of the rider. Nowadays some manufacturers may advertise a particular model of personal watercraft as a "jet ski," a term which, perhaps a remnant from the earlier days of normally standing operation of personal watercraft, still sees somewhat interchangeable popular usage with the term "personal watercraft."

So popular are personal watercraft that their use has been regulated by various jurisdictions. The State of Maryland, for example, has promulgated regulations regarding definition and operation of personal watercraft.

The Code of Maryland Regulations, Title 08 (entitled "Department of Natural Resources"), Subtitle 18 (entitled "Boating—Speed Limits and Operation of Vessels"), Chapter 02 (entitled "Personal Watercraft"), section 0.04 (entitled "Definitions"), essentially defines a "Personal watercraft" as a "motorboat less than 16 feet in length" which: "(a) Has an inboard motor which uses an internal combustion engine powering a water jet pump as its primary source of motive propulsion; (b) Is designed with the concept that the operator and passenger ride on the outside surfaces of the vessel as opposed to riding inside the vessel; (c) Has the probability that the operator and passenger may, in the normal course of use, fall overboard; and (d) Is designed with no open load carrying area which would retain water."

In addition, the Code of Maryland Regulations, Title 08, Subtitle 18, Chapter 02, section 0.04 defines a "Specialty prop craft" as "a vessel less than 16 feet in length similar in appearance and operation to a personal watercraft but the primary source of propulsion is a propeller," and further states, "For the purpose of this chapter, a specialty prop craft shall be considered a personal watercraft."

Commercial personal watercraft, as conventionally known and as considered herein, are generally less than sixteen feet in length and designed so as to permit one, two or three riders to be situated on the outside of a generally outwardly configured vehicle, rather than inside a generally inwardly configured vehicle as in most other types of marine vessels. The propulsion of a personal watercraft is typically by means of waterjet ("jet pump type" propulsion) and/or rotor blade propeller ("impeller type" propulsion).

A personal watercraft is designed to have no configurationally "open" spaces which are significantly water-retentive. The high probability expectation for personal watercraft is that, in normal usage, the rider or riders will fall overboard. Hence, for rider and vehicle protection, commercial personal watercraft are generally made to be both self-righting and self-bailing.

The present invention provides a marine surface vehicle which is adaptable to unmanned use, comprising an upper section which includes an inverted open shell, and a lower section which includes the hull of a personal watercraft.

This invention also provides a method for making a marine surface vehicle which is adaptable to unmanned use, comprising providing an inverted open shell, providing the hull of a personal watercraft, and coupling the shell and the hull.

The present invention further provides an unmanned marine surface vehicle system, comprising a vehicle, means for remotely controlling the vehicle, and means for propelling the vehicle; the vehicle comprises an upper section which includes an inverted open shell and a lower section which includes the hull of a personal watercraft.

The present invention uniquely features autonomous or semi-autonomous, unmanned, remote operation by a relatively small vehicle which is based on a personal watercraft hull form. The unmanned marine (sea) surface vehicle according to this invention lends itself both to military applications (e.g., naval decoy deception for surface ships and submarines; remotely piloted minesweeping; buoy deployment) and to civilian applications (e.g., in the commercial fishing industry, wherein small boats are used to drag nets around schools of fish). The autonomous or semi-autonomous vehicle according to this invention, by virtue of its size being commensurate with that of a personal watercraft and significantly smaller than that of marine vessels which have conventionally been considered for autonomous or semi-autonomous operations, not only enhances present performance capabilities but offers new performance capabilities.

This invention thus expands the possibilities and parameters of marine applications wherein utilization of one or more autonomous or semi-autonomous vessels can reduce risk to personnel and to property. Applications such as those proposed by the aforediscussed article for the larger remotely operated BARRACUDA in *Unmanned Systems* Winter 1995 may be better performed by the considerably smaller (and hence appreciably more versatile) remotely operated vehicle in accordance with the present invention. The vehicle according to the present invention is more maneuverable than larger vehicles, and can negotiate shallow and/or congested waters with greater facility than can larger vehicles.

The relatively lightweight vehicle according to the present invention is more easily deployable and recoverable than are larger, heavier vehicles having lower seastate capability; the vehicles of this invention can literally be dropped into bodies of water from great heights. Potential deployment techniques for the present invention include (but are not limited to) winch, net, chute, over-the-side, well deck release, plane or helicopter drop, and torpedo tube.

The unmanned marine surface vehicle according to this invention features a small, lightweight, compact, durable, rugged construction having a substantially sealed, pistachio shell-like outer casing which encapsulates the inner mechanical and electronic components. The fluid-dynamic lines and mass distribution of the vehicle enhance the already formidable seastate capability of the self-righting, self-bailing personal watercraft from which the vehicle derives. The propulsive/steering capability, whether of the waterjet type or the rotor propeller type, advantageously is direct and uncomplicated; exclusive implementation of a waterjet renders the vehicle of this invention even more damage-resistant because of the absence of any exposed rotor impellers.

Modification of a personal watercraft so as to become the unmanned marine surface vehicle according to this invention should be a cost-effective proposition for most if not all applications. The vehicle may even be expendable for some applications. A variety of personal watercraft can be commercially obtained relatively inexpensively, and economical techniques for their modification according to this invention should be readily apparent to ordinarily skilled artisans. Inside the vehicle, the mechanical and electronic components are appropriately packaged and can be efficiently modularized for larger scale implementation. For example, the electronics package which pertains to electronic countermeasures or mining countermeasures can be rendered easily upgradeable to a "next-generation" package.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described by way of example, with reference to the accompanying drawings, wherein like numbers indicate the same or similar components, and wherein.

DETAILED DESCRIPTION OF THE INVENTION

Figure 1:
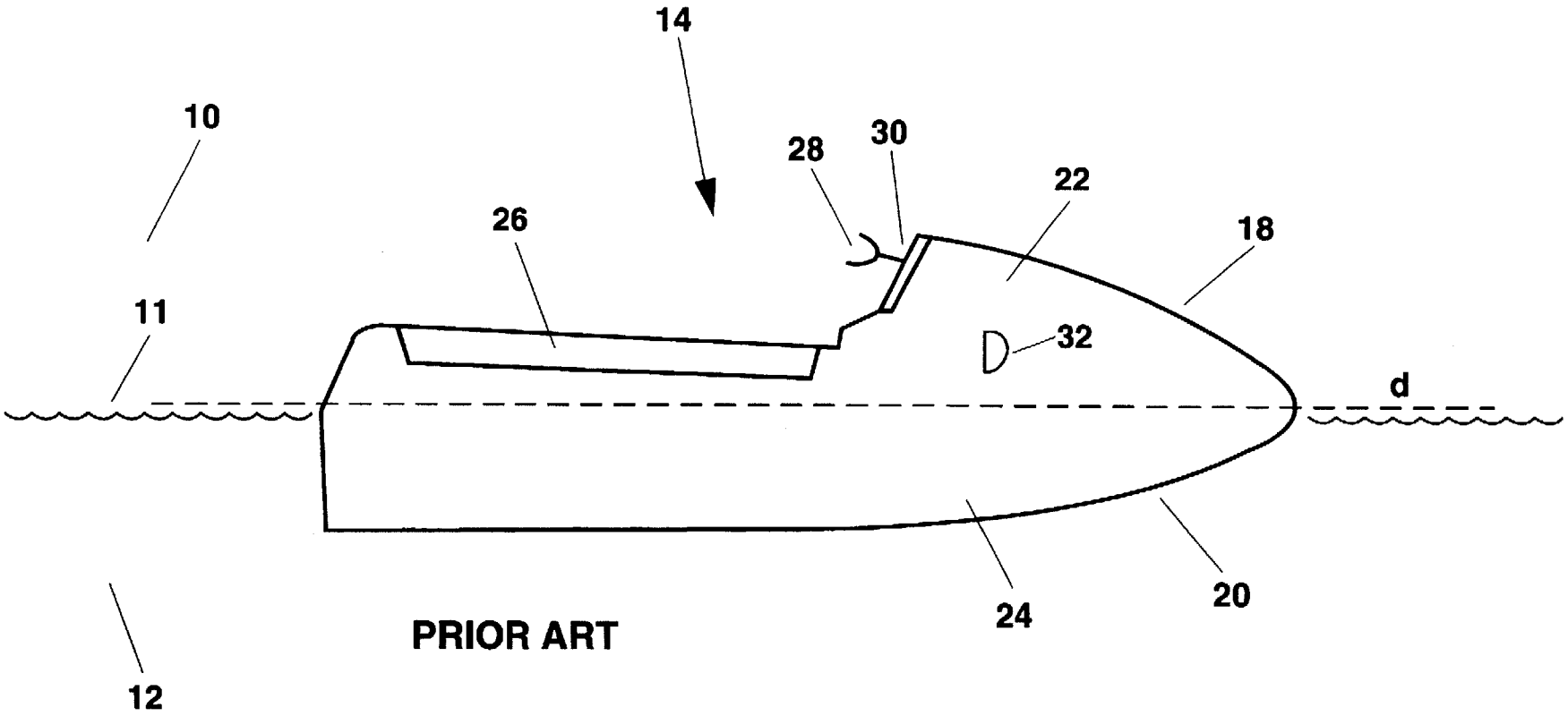
PRIOR ART FIG. 1
FIG. 1 is a diagrammatic starboard elevation view of a typical commercially available personal watercraft.

Referring now to FIG. 1, air 10 exists above surface 11 of water 12. Personal watercraft ("PWC") 14 in its basic form is shown situated in water 12. For illustration purposes, dashed demarcation line d marks the horizonal boundary plane between upper section 18 and lower section 20 of personal watercraft 14. In normal modes of operation, water surface 11 generally falls slightly below the horizontal plane defined by dashed demarcation line d.

Two separate casings, viz., body/cowl 22 (included in upper section 18) and hull 24 (included in lower section 20), are coupled at the horizontal plane defined by demarcation line d. Also included in upper section 18 and exteriorly visibly housed by body/cowl 22 are seating area 26, steering mechanism 28, display panel 30 and side/rear view mirrors 32 (one shown).

Also included in lower section 20 and contained by hull 24 are the engine (not shown) and the propulsion/steering device (not shown) which is either "jet pump type" (waterjet) or "impeller type" (rotor blade propeller). Upper section 18 may include other apparatus (not shown) suitable for manned operation of personal watercraft 14. Also not shown in FIG. 1 are various other mechanical or structural features or embellishments which may accompany personal watercraft 14. Structurally, for example, many models of personal watercraft have a step-like or bumper-like protuberance which is nearly even with demarcation line d and which completely or substantially encircles personal watercraft 14.

Figure 2:
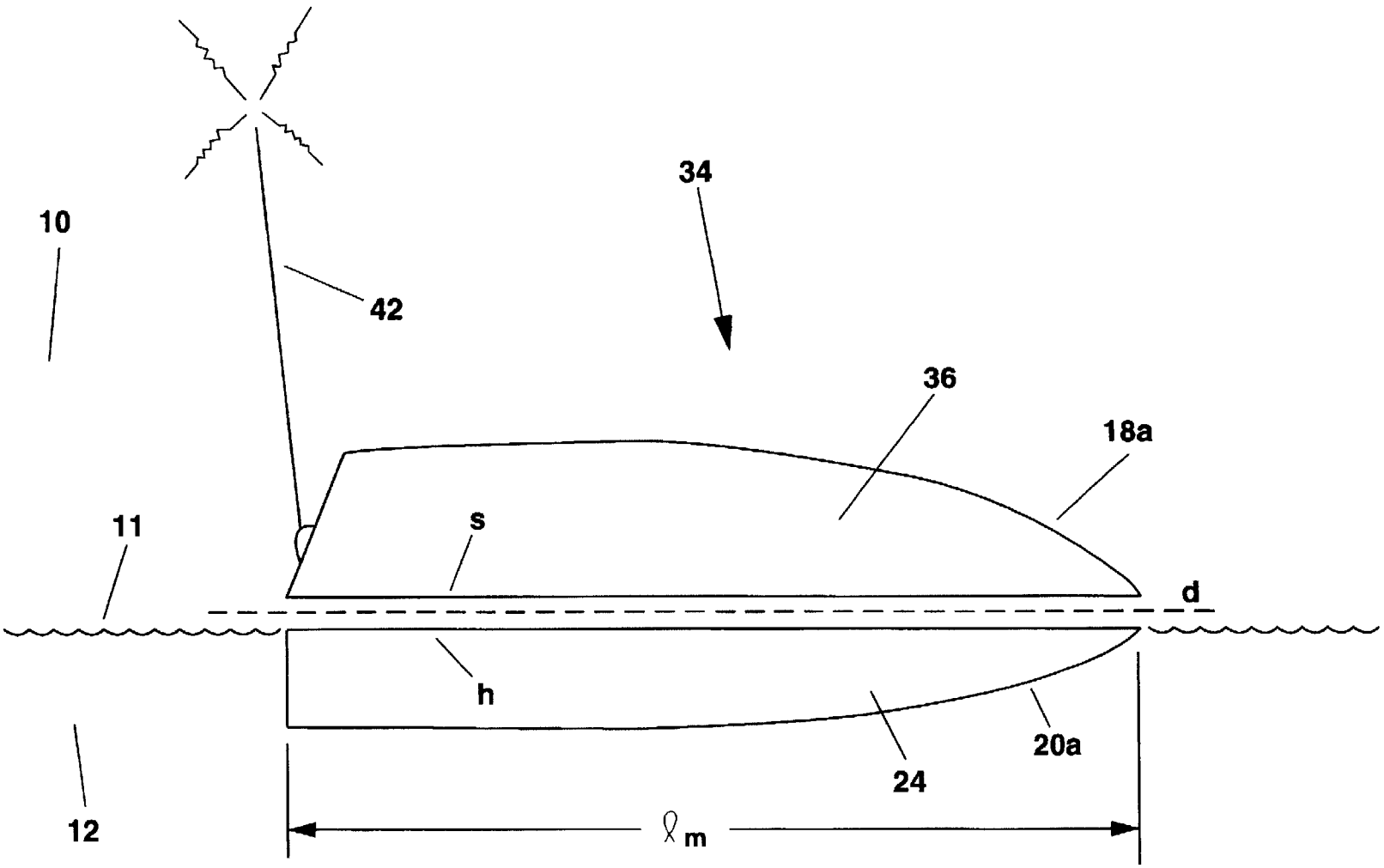
FIG. 2 is a view, similar to the view presented in FIG. 1, of an unmanned marine surface vehicle in accordance with the present invention.
Figure 3:
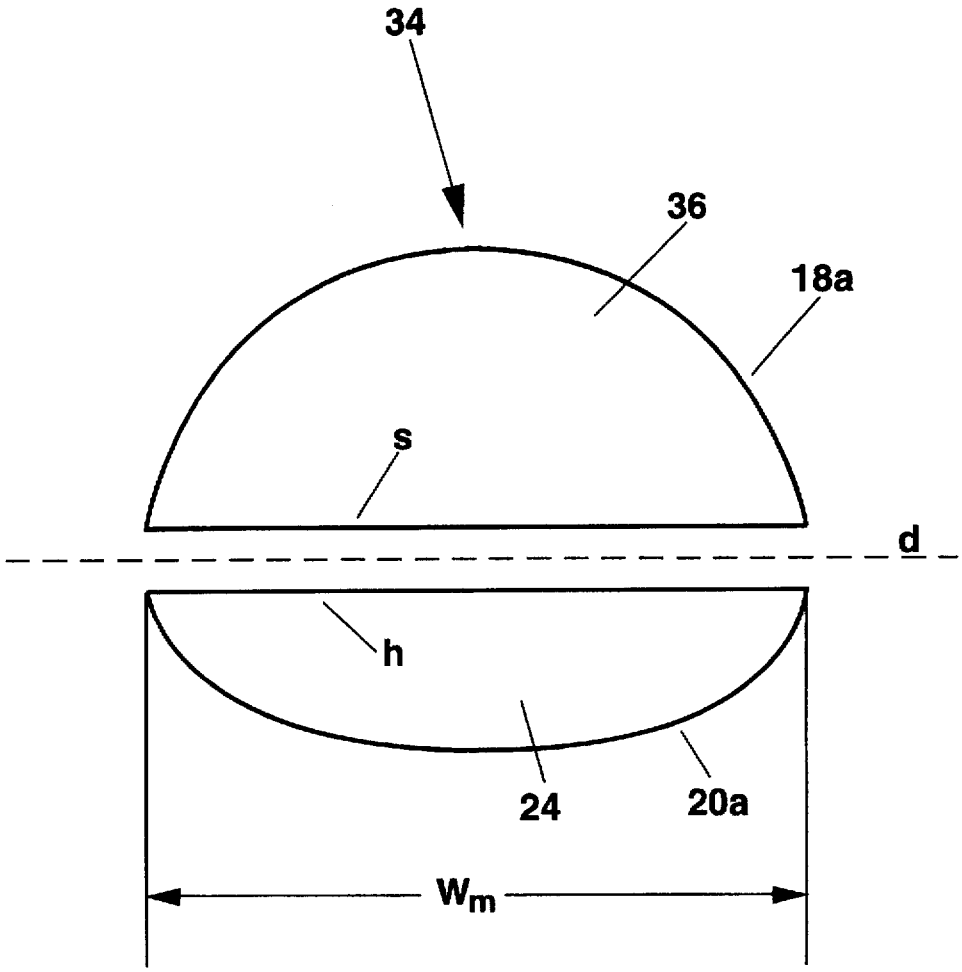
FIG. 3 is a diagrammatic frontal elevation view of the unmanned marine surface vehicle shown in FIG. 2.

With reference to FIG. 2, and FIG. 3, personal watercraft 14 has been modified according to this invention so as to become unmanned marine surface vehicle ("UMSV") 34. Dashed demarcation line d illustratedly marks the horizontal planar boundary between upper section **18*a* and lower section 20*a* of unmanned marine surface vehicle (UMSV) 34 in accordance with the present invention. Hull 24 of personal watercraft 14 has been retained and included in lower section 20*a* of unmanned marine surface vehicle 34. Upper section 18 of personal watercraft 14 has been entirely removed and replaced by upper section 18*a* of unmanned marine surface vehicle 34**.

Figure 6:
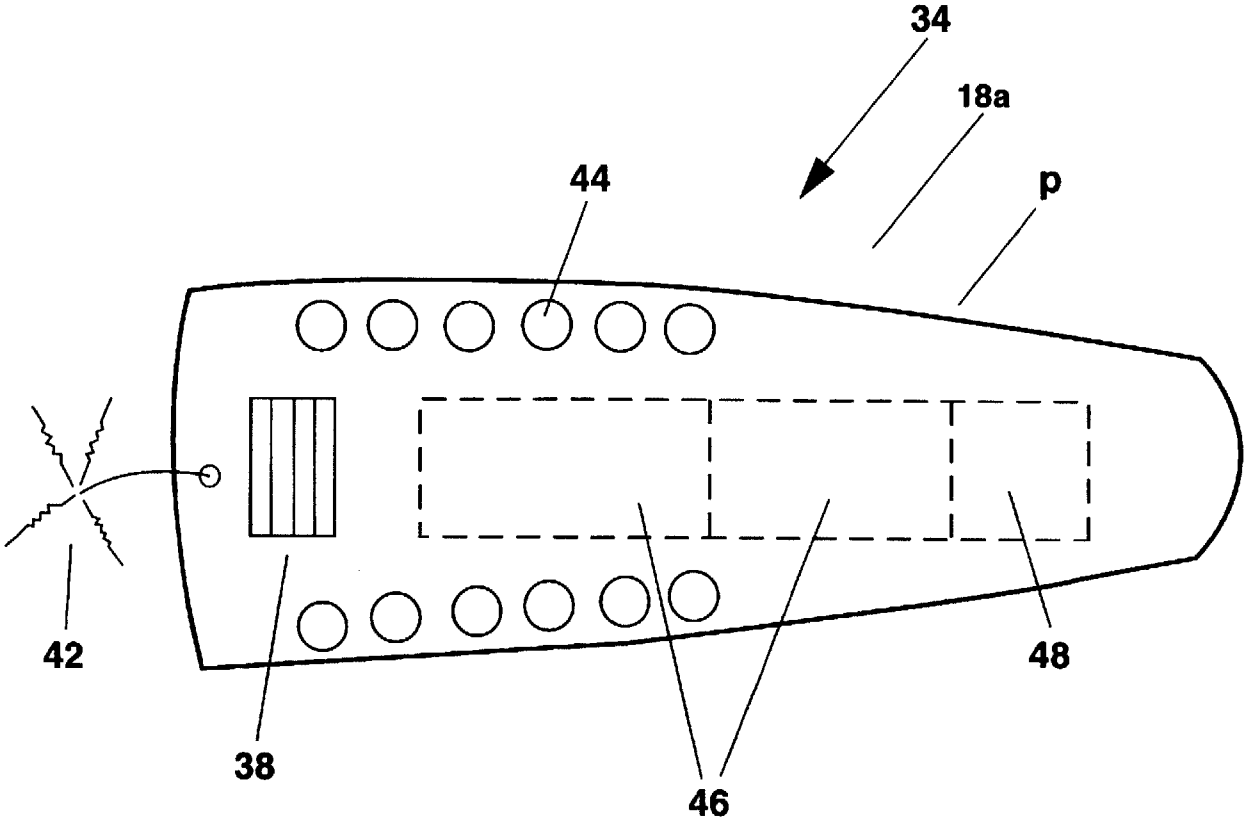
FIG. 6 is a diagrammatic top plan view which shows some interior detail in the upper section of the unmanned marine surface vehicle shown in FIG. 2.
Figure 7:
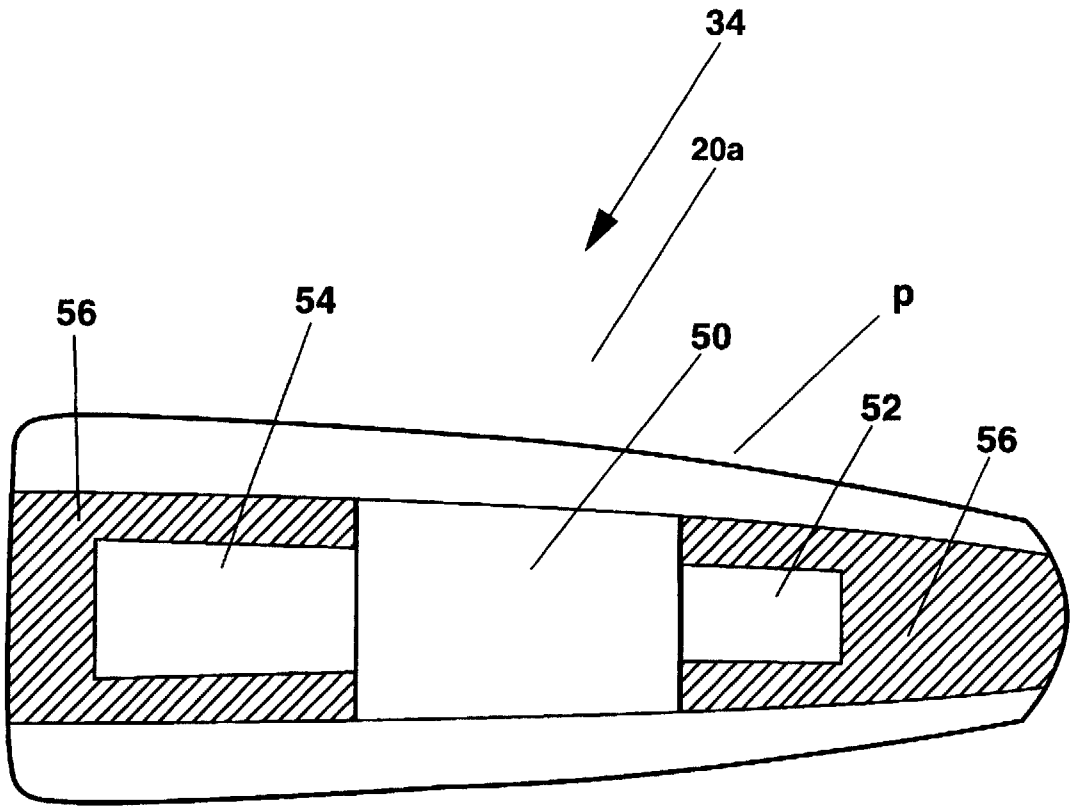
FIG. 7 is the view presented in FIG. 6 which shows some interior detail in the lower section of the unmanned marine surface vehicle shown in FIG. 2.

The casing for upper section **18*a* is open inverted shell 36, a dome-like or bubble-like structure which serves as both a fluid-dynamic "fairing" and an enclosure. The casing for lower section 20*a* is hull 24. Also exteriorly visible is at least one antenna 42 (one shown) for remote communication and, for some embodiments, for receiving GPS signals. Perimeter p, shown in FIG. 6 and FIG. 7, is the outer boundary of unmanned marine surface vehicle 34** and lies approximately in the plane defined by demarcation line d.

The bottom peripheral edge s of shell 36 is in concordance with the top peripheral edge h of hull 24. Bottom peripheral edge s of shell 36 and top peripheral edge h of hull 24 flushly engage along the entire perimeter p, thereby coupling shell 36 and hull 24, preferably forming therearound a substantially fluid-tight seal. Bottom peripheral edge s of shell 36, top peripheral h edge of hull 24, and perimeter p of vehicle 34 are all virtually congruent, bottom peripheral edge s thereby meeting top peripheral edge h approximately at perimeter p and approximately in the plane defined by demarcation line d.

Shell 36 is generally intended, according to this invention, to have sufficiently capacity for containing apparatus pertaining to remote vehicular control and to effectuation of one or more unmanned operations; hence, shell 36 of vehicle 34 which is described herein with reference to the figures has a substantially convex shape which convexly bulges approximately coextensively with perimeter p. For some embodiments of this invention, however, shell 36 has a shape which is centrally convex and peripherally concave, i.e., a shape which convexly bulges and then concavely approaches the bottom edge of shell 36 so as to be coextensive with perimeter p.

Shell 36 is a hollow, inverted, oblong structure having a generally convex outer surface which, to a substantial degree, is smooth, curvilinear and continuous. The outer surface of shell 36 is configured to provide space as well as to promote aerodynamic efficiency and hydrodynamic efficiency of unmanned marine surface vehicle 34, especially to reduce drag. Because the same hull 24 is used for vehicle 34 as was used for personal watercraft 14, the stern of vehicle 34 has retained a rectilinear structural character similar to that exhibited by the stern of personal watercraft 14.

According to this invention, the upward convexity of shell 36 and the downward convexity of hull 24 are structurally and fluid-dynamically complementary. Shell 36 and hull 24 are exterior structural counterparts akin to the half-shells which together form a complete, intact, closed pistachio shell. Vehicle 34 has a somewhat flattened bullet-like shape which commences in the front with a substantially curvilinear ("rounded") bow and concludes in the rear with a substantially rectilinear ("squared") stern. The shape of vehicle 34 is analogous to that of a prolate ellipsoid which is curved at the front end and, in effect, is angularly segmented at the back end; the polar axis of the ellipsoid runs fore and aft (lengthwise), the equatorial diameter of the ellipsoid runs starboard and port (widthwise).

For most embodiments vehicle 34 has a maximum fore-and-aft length $l_m$ (polar axis) which is between twice and four times its maximum starboard-and-port width $w_m$ (equatorial diameter), the length and the width each being measured along perimeter p in the plane defined by demarcation line d. For many embodiments maximum length $l_m$ is approximately 7 to 10 feet and maximum width $w_m$ is approximately 2 to 4 feet. The width of vehicle 34 generally increases along its length in the aftward direction; starting from the fore of most embodiments of vehicle 34, the width at first more steeply increases, and then more gradually increases, and then approaches or achieves constancy at a value near or at the value of maximum width $w_m$.

The hydrodynamic and buoyant efficiencies which have been built into commercially obtained hull 24 are expediently taken advantage of by unmanned marine surface vehicle 34. Reconfiguration and mass redistribution vis-a-vis' upper section 18 result in upper section **18*a*, and mass redistribution vis-a-vis' lower section 20 results in lower section 20*a*. Buoyancy, stability and seaworthiness of vehicle 34 are promoted by the mass distribution of lower section 20*a* and especially by the shape and mass distribution of upper section 18*a*. Vehicle 34 is "weighted" and configured so as to raise the center of gravity of vehicle 34 vis-a-vis' the center of gravity which had existed for personal watercraft 14**.

The intrinsic buoyancy of personal watercraft 14 presupposes normally seated positioning thereupon by the rider or riders; hence, personal watercraft 14 by itself is designed to have a center of gravity which is relatively low so as to compensate for the mass of "human cargo" when in use. By contrast, vehicle 34 presupposes being unmanned and hence by itself has a higher center of gravity, as manifested by the distribution of solely nonhuman mass, especially in upper section **18*a*, which is carried by vehicle 34. Nevertheless, in normal modes of operation of vehicle 34, water surface 11 generally settles at or tends toward a relative level similar to that for normal modes of operation of personal watercraft 14**, i.e., at a level slightly below the horizontal plane defined by dashed demarcation line d.

The qualities of self-righting and self-bailing, inherent in personal watercraft 14, have been at least maintained and for some embodiments enhanced for vehicle 34 according to this invention. Vehicle 34 is virtually fully self-contained and watertight such that temporary total immersion, for example when vehicle 34 is covered by a wave, does not disrupt vehicle 34.

Figure 4:
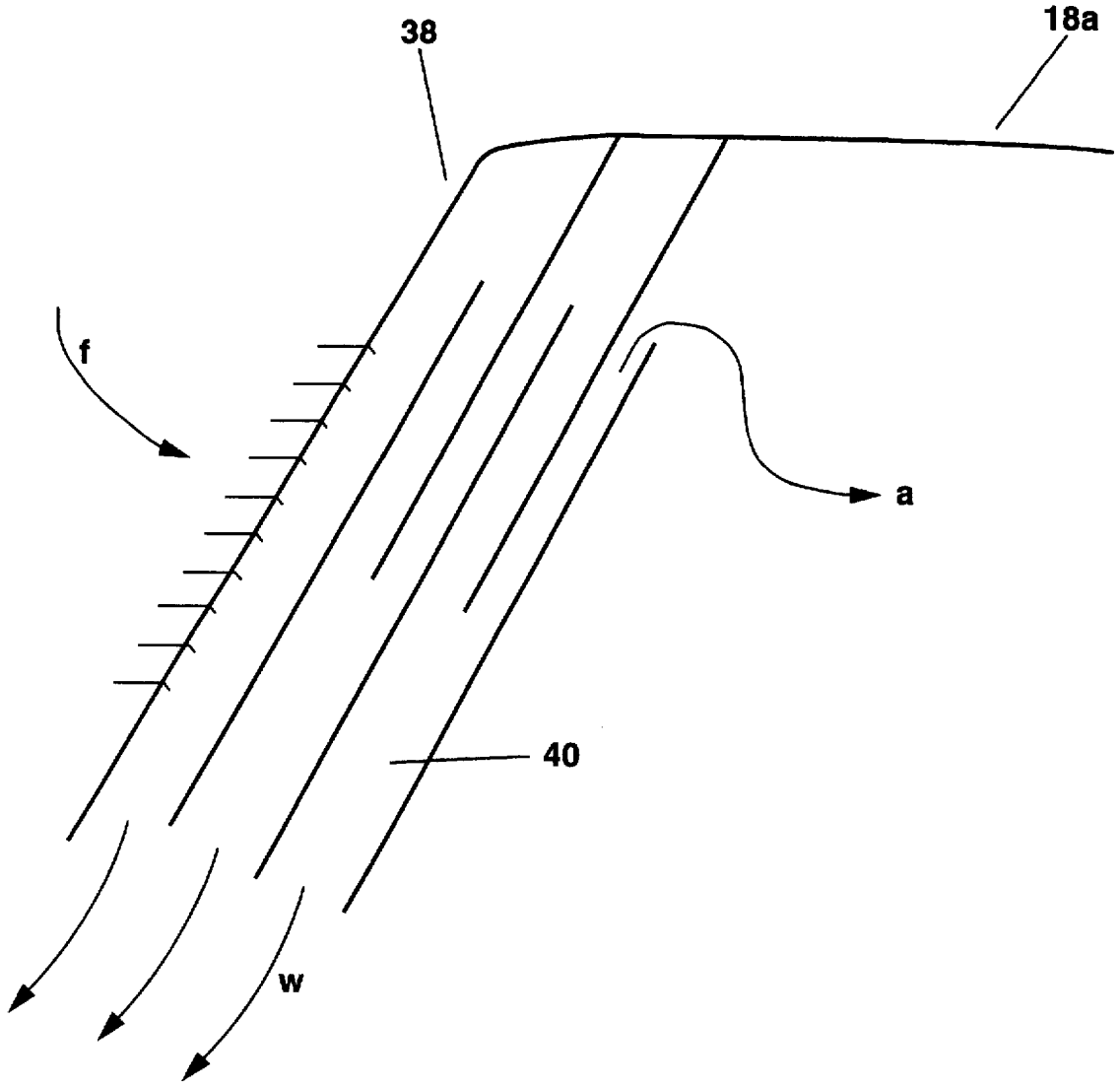
FIG. 4 is an enlarged and partial view, similar to the view presented in FIG. 2, which shows some interior detail in the upper aft section of the unmanned marine surface vehicle shown in FIG. 2.

For some embodiments of this invention, air baffling is provided in upper section **18*a* as an additional measure in furtherance of buoyancy, stability and seaworthiness. Reference now being made to FIG. 4, air baffling 38 (also shown in FIG. 6) provided at the rectilinear stern area of upper section 18*a* provides sufficient air volume within vehicle 34 to permit continued operation of vehicle 34 despite its temporary total immersion. Fluid (primarily air and secondarily water) enters baffling 38 as shown by arrow f. Water outlets 40 lead as shown by arrows w to an internal sump (not shown) located in lower section 20*a* (not shown) of vehicle 34. Air is directed as shown by arrow a to engine 50 (shown in FIG. 7) located in lower section 20*a*. The baffling 38 air inlet to engine 50 must be substantially leakproof so as to preclude internal flooding of vehicle 34** when totally submerged.

Figure 5:
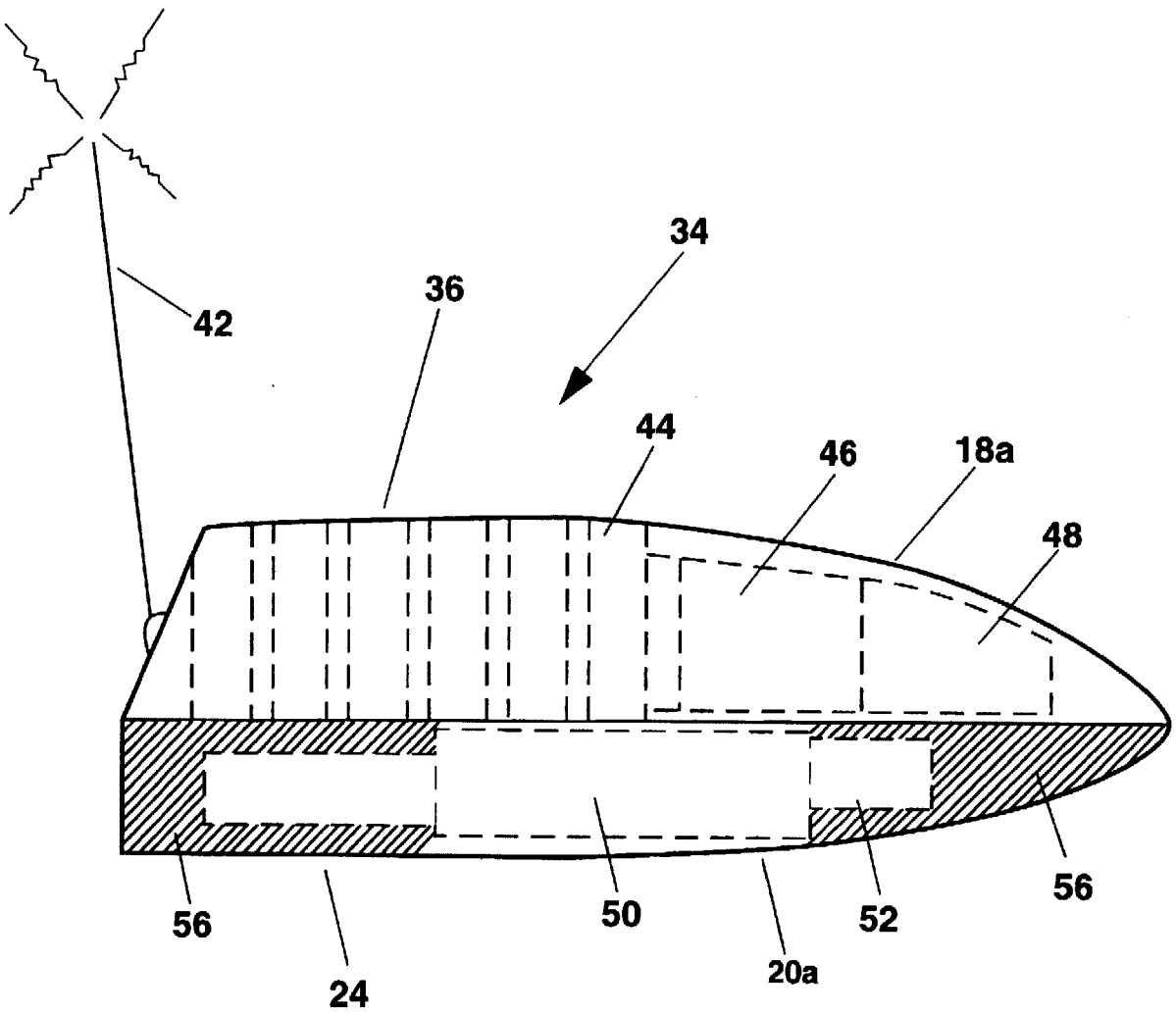
FIG. 5 is the view presented in FIG. 2 which shows some interior detail in the unmanned marine surface vehicle shown in FIG. 2.

Shell 36 is appropriately contoured not only for affording superior fluid-dynamic performance but also for providing abundant containment space. Reference now being made to FIG. 5 and FIG. 6, upper section **18*a* includes baffling 38 (shown in in FIG. 6), at least one antenna 42 (one antenna 42 shown), canister/flare exits 44, at least one electronic countermeasures and/or mine countermeasures ("ECM/MCM") package 46 (front package 46 shown in FIG. 5, both front package 46 and back package 46 shown in FIG. 6) and remote control package 48**.

Canister/flare exits 44, provided along each side of vehicle 34, can be used for carrying and/or deploying at least one of the following (or other) types of devices, depending upon the invention's application: infrared flares, radar chaff, self-rotating cavitation disks and buoys.

For many military applications of the present invention, vehicle 34 can be directed to strategical or tactical warfare activities. Electronic warfare ("EW") is generally considered to include electronic support measures ("ESM," also known as "passive electronic warfare" or "passive EW"), electronic countermeasures ("ECM," also known as "active electronic warfare" or "active EW"), and electronic counter-countermeasures ("ECCM"). Various methods and apparatuses for effectuation of electronic warfare are known in the art. Instructive is Kiely, Dr. D. G., *Naval Electronic Warfare*, Brassey's Defence Publishers, Vol. 5 of Brassey's Sea Power: Naval Vessels, Weapons Systems and Technology Series, McLean, Va., 1988.

Each ECM/MCM package 46 is "mission specific." Active electronic warfare generally involves the spoiling of enemy transmissions for enemy use. The package 46 ECM capability of vehicle 34 can be used to create false radar or other misleading signaling in order to draw enemy weaponry toward the vehicle 34 decoy rather than toward the host vessel. Moreover, flare devices (by creating false infrared signatures) and/or chaff devices (by creating false radar echoes), deployed from canister/flare exits 44, can be used to confuse incoming hostile weapons systems prior to the weapon(s) reaching a battle group.

An ECM/MCM package 46 can be additionally or alternatively used for effecting mine countermeasures. Minesweeping capability can be afforded by incorporation, in upper section **18*a* of each of one or more vehicles 34, of an ECM/MCM package 46 designed for the detection of mines expected to be encountered. Canister/flare exits 44 can be loaded or reloaded with buoys to mark suspected mine locations for further investigation or ship avoidance. Furthermore, acoustic mines can be addressed by using vehicle 34 to tow self-rotating cavitation disks which have been deployed from canister/flare exits 44**.

In all modes of performance of mine countermeasures, operator safety is assured, since each vehicle 34 is unmanned and capable of being remotely piloted. Larger areas of minesweeping operation can be addressed, since multiple remote vehicles 34 can be operated from either a minesweeper or aerial platform.

Remotely controlled, autonomous/semi-autonomous operation by vehicle 34 can be afforded by means of radio communication and/or by other means of communication. Remote control package 48 essentially provides the hardware and software for remote piloting of unmanned vehicle 34. Techniques for monitoring and/or guidance and/or stationing of remotely located moving objects are well known in the art, and more conventionally involve radio communication. A remote control system which involves radio telemetry, such as that disclosed for the BARRACUDA vehicle discussed hereinabove, is suitable for many embodiments of the present invention.

Remote operation of vehicle 34 can also be accomplished using pulsed laser communication technology. Unlike radio waves, pulsed lasers advantageously permit jam-proof operations; however, application of pulsed laser communication technology may be unique in a marine environment, and some development may be required. In addition, the relatively small size of vehicle 34 may render difficult the locating of the laser device in vehicle 34 for purposes of effecting such communicating. A possible solution is the incorporation of a Luneberg lens into vehicle 34 as a fuel cache whereby the Luneberg lens reflects a larger radar signature than does the vehicle 34 construction, which for most embodiments is substantially composite.

Commercially available personal watercraft such as personal watercraft 14 shown in FIG. 1 perhaps most typically are propelled and steered by a waterjet device and driven by a gasoline-fired engine. With reference to FIG. 7 and still with reference to FIG. 5, lower section 20*a* includes engine 50, generator 52, waterjet propulsion/steering device 54 and fuel tank 56.

For many embodiments of this invention, vehicle 34 essentially retains in lower section 20*a* the waterjet 54 propulsion/steering mechanism which had been part of lower section 20 of personal watercraft 14. Some embodiments of vehicle 34 can instead, or in addition, suitably incorporate the rotar blade impeller mechanism which had originally been included in a personal watercraft 14. However, waterjet propulsion is preferable to impeller propulsion in practicing many embodiments of this invention; axial flow waterjet device 54 advantageously provides a simplified direct-drive propulsive and steering capability which lacks the vulnerability of one or more exposed rotor propellers.

Fuel tank 56 for some embodiments is the fuel tank which had been utilized for personal watercraft 14; however, many embodiments of this invention preferably substitute for the personal watercraft 14 fuel tank a significantly larger, appropriately lined fuel tank 56 which occupies virtually all, or at least a substantial portion of, available space in lower section 20*a*. The maximimation of the fuel tank capacity for vehicle 34 can significantly increase the duration and degree of operation which is made possible by a single fueling.

Incorporated in lower section 20*a* of vehicle 34 is generator 52, which is driven off the crankshaft of engine 50. Generator 52 provides electrical power of approximately 2 to 3 kilowatts to electronic countermeasures package 46 and remote control package 48. For some embodiments electrical conditioning equipment (not shown) may be necessary to condition the power generated by generator 52 for applicability to ECM package 46 and/or remote control package 48.

For some embodiments of this invention, vehicle 34 retains as engine 50 in lower section 20*a* the gasoline-fired engine which had been part of lower section 20 of personal watercraft 14. However, many embodiments preferably substitute for the gasoline-fired engine a non-gasoline fired engine, implementing technology which is known in the art such as is being developed by the U.S. Navy.

A two-cycle, 50 horsepower, jet propellent (JP-5) fueled, water-cooled engine has been considered and used by the U.S. Navy for applications involving non-gasoline engine-driven portable damage control systems as well as those involving portable pumping systems; this engine developed by the U.S. Navy is a modified form of a conventional marine two-cycle outboard engine which is well suited to the marine environment. Hence, implementation by the present invention of a "tried and true" engine (e.g., for military applications by the U.S. Navy) can provide operational and maintenance benefits in terms of cost-effectiveness, dependability and familiarity.

Generally, for a typical embodiment of vehicle 34 having a maximum length $l_m$ of approximately 7 to 10 feet and a maximum width $w_m$ of approximately 2 to 4 feet, it may be expected that vehicle 34 is approximately 800 pounds in gross weight, has a sea state 5 capability, and has a axial flow waterjet and a 50 horsepower watercooled marine engine which afford the approximate capabilities of 35+ knot speed and of 8 to 12 hours of continuous operation at about 35 to 50 knots.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A marine surface vehicle which is adaptable to unmanned use, comprising:

an upper section which includes an enclosure which is upside protuberant and downside hollow, said enclosure having a faired upside surface which is substantially curvilinear, substantially smooth add substantially continuous and is fluid-dynamically contoured to reduce drag, said enclosure having a bottom peripheral edge; and a lower section which includes a hull having a top peripheral edge, said bottom peripheral edge and said top peripheral edge being approximately congruent;

wherein said vehicle has a length which is less than sixteen feet and is between twice and four times its width as measured in the imaginary horizontal plane which separates said enclosure and said bull, said vehicle having a substantially curved bow and a substantially angular stern, aftward from said bow said width at first more steeply increasing and then more gradually increasing and then approaching constancy, said enclosure and said hull being substantially flushly coupled so that the junction of said bottom peripheral edge and said top peripheral edge is substantially fluid-tight, said junction approximately defining the perimeter of said vehicle, said perimeter approximately lying in said imaginary horizontal plane, said enclosure having a shape which convexly bulges approximately coextensively with said perimeter, said enclosure convexly bulging approximately coextensively with said length so that, in cross-section fore-and-aft, said enclosure is substantially curvilinear aftward from said bow and then becomes substantially rectilinear approximately parallel to said imaginary horizontal plane and then at said stern becomes substantially rectilinear at an acute angle with respect to said imaginary horizontal plane, said enclosure convexly bulging approximately coextensively with said width so that, in cross-section starboard-and-port, said enclosure substantially defines an approximate semiellipse.

2. A marine surface vehicle as in claim 1, wherein said upper section includes at least one means selected from the group of means consisting of remote control means, electronic countermeasure means, mine countermeasure means, canister launching means, flare launching means and air baffling means.

3. A marine surface vehicle as in claim 1, wherein said lower section includes at least one means selected from the group of means consisting of engine means, generator means, fuel containment means and waterjet propulsion means.

4. An unmanned marine surface vehicle system, comprising:

a vehicle comprising an upper section and a lower section, said upper section including an enclosure which is upside protuberant and downside hollow, said enclosure having a faired upside surface which is substantially curvilinear, substantially smooth add substantially continuous and is fluid-dynamically contoured to reduce drag, said lower section including a hull, said enclosure having a bottom peripheral edge, said hull having a top peripheral edge, said bottom peripheral edge and said top peripheral edge being approximately congruent, said enclosure and said hull being substantially flushly coupled so that the junction of said bottom peripheral edge and said top peripheral edge is substantially fluid-tight, said junction approximately defining the perimeter of said vehicle, said perimeter approximately lying in the imaginary horizontal plane which separates said upper section and said lower section, said vehicle having a length which is less than sixteen feet and is between twice and four times its width as measured in said imaginary plane, said vehicle having a substantially curved bow and a substantially angular stern, aftward from said bow said width at first more steeply increasing and then more gradually increasing and then approaching constancy, said shell having a shape which convexly bulges approximately coextensively with said perimeter, said enclosure convexly bulging approximately coextensively with said length so that, in cross-section fore-and-aft, said enclosure is substantially curvilinear aftward from said bow and then becomes substantially rectilinear approximately parallel to said imaginary horizontal plane and then at said stern becomes substantially rectilinear at an acute angle with respect to said imaginary horizontal plane, said enclosure convexly bulging approximately coextensively with said width so that, in cross-section starboard-and-port, said enclosure substantially defines an approximate semiellipse;

means for propelling said vehicle; and means for remotely controlling said vehicle.

5. An unmanned marine surface vehicle system as in claim 4, further comprising means for effecting warfare countermeasures from said vehicle.

6. An unmanned marine surface vehicle system as in claim 5, wherein said means for effecting warfare countermeasures includes at least one means selected from the group of means consisting of electronic countermeasure means and mine countermeasure means.

7. An unmanned marine surface vehicle system as in claim 5, wherein said means for effecting warfare countermeasures includes means for launching at least one object selected from the group of objects consisting of infrared flare, radar chaff, self-rotating cavitation disk and buoy.

8. An unmanned marine surface vehicle system as in claim 4, wherein said means for propelling said vehicle includes an engine, a fuel tank and a waterjet propeller.

9. An unmanned marine surface vehicle system as in claim 4, wherein said upper section includes air baffling means.

10. An unmanned marine surface vehicle system as in claim 4, further comprising means aboard said vehicle for generating electrical power.

* * * * *